US006693052B2

(12) United States Patent
Howland

(10) Patent No.: US 6,693,052 B2
(45) **Date of Patent: *Feb. 17, 2004**

(54) GARMENT INCLUDING PROTECTIVE FABRIC

(75) Inventor: Charles A. Howland, Temple, NH (US)

(73) Assignee: Warwick Mills, Inc., New Ipswich, NH (US)

( * ) Notice: Subject to any disclaimer, the term of this patent is extended or adjusted under 35 U.S.C. 154(b) by 50 days.

This patent is subject to a terminal disclaimer.

(21) Appl. No.: 09/736,930

(22) Filed: Dec. 14, 2000

(65) Prior Publication Data

US 2001/0002351 A1 May 31, 2001

Related U.S. Application Data

(63) Continuation of application No. 09/453,773, filed on Dec. 3, 1999, now Pat. No. 6,548,430, which is a continuation of application No. 09/289,208, filed on Apr. 9, 1999, which is a division of application No. 09/037,918, filed on Mar. 10, 1998, now Pat. No. 5,976,996, which is a continuation of application No. 08/729,926, filed on Oct. 15, 1996, now Pat. No. 5,837,623.

(51) Int. Cl.[7] ..... D03D 15/00

(52) U.S. Cl. ..... 442/189; 442/135; 442/208; 428/902; 428/911; 139/383 R; 2/2.5

(58) Field of Search ..... 442/135, 189, 442/208; 428/902, 911; 139/383 R; 2/2.5

(56) References Cited

U.S. PATENT DOCUMENTS

| | | | | |
|---|---|---|---|---|
| 1,049,313 | A | | 12/1912 | Murphy et al. |
| 1,156,155 | A | | 10/1915 | Landis |
| 1,181,065 | A | | 4/1916 | Coffield |
| 1,217,754 | A | | 2/1917 | Grube |
| 1,226,703 | A | | 5/1917 | Schmidt |
| 1,273,446 | A | | 7/1918 | Belton |
| 1,297,408 | A | | 3/1919 | Schuster |
| 1,300,980 | A | | 4/1919 | LeDoux |
| 1,305,622 | A | | 6/1919 | Rawdon et al. |
| 1,346,632 | A | | 7/1920 | Bennett |
| 1,371,097 | A | | 3/1921 | Jones |
| 1,401,306 | A | | 12/1921 | Bird |
| 1,474,387 | A | | 11/1923 | Schoneberger |
| 3,563,294 | A | | 2/1971 | Chien ..... 152/346 |
| 3,831,653 | A | | 8/1974 | Moore ..... 152/195 |
| 3,935,892 | A | | 2/1976 | Arimura et al. ..... 152/330 |
| 3,982,577 | A | | 9/1976 | Scimeca ..... 152/204 |
| 4,008,743 | A | | 2/1977 | Welch ..... 152/158 |
| 4,043,609 | A | | 8/1977 | Vidakovic et al. ..... 305/19 |
| 4,132,258 | A | | 1/1979 | Vidakovic et al. ..... 152/185 |
| 4,158,378 | A | | 6/1979 | Pearson et al. ..... 152/353 |
| 4,197,893 | A | | 4/1980 | O'Coin ..... 152/310 |
| 4,231,407 | A | | 11/1980 | James ..... 152/351 |
| 4,249,587 | A | | 2/1981 | Duttlinger ..... 152/354 |
| 4,254,810 | A | | 3/1981 | Shichman ..... 152/205 |
| 4,275,782 | A | | 6/1981 | McFarlane ..... 152/314 |
| 4,356,214 | A | | 10/1982 | Soeda et al. ..... 427/233 |
| 4,388,261 | A | | 6/1983 | Codispoti et al. ..... 264/171 |
| 4,403,012 | A | | 9/1983 | Harpell et al. ..... 442/135 |
| 4,664,168 | A | | 5/1987 | Hong et al. ..... 152/504 |
| 4,737,401 | A | | 4/1988 | Harpell et al. ..... 428/252 |
| 4,743,497 | A | | 5/1988 | Thorsrud ..... 428/286 |
| 4,816,101 | A | | 3/1989 | Hong et al. ..... 156/244 |
| 4,852,625 | A | | 8/1989 | Mashimo et al. ..... 152/511 |
| 4,868,040 | A | | 9/1989 | Hallal et al. ..... 428/251 |
| 5,085,942 | A | | 2/1992 | Hong et al. ..... 428/492 |
| 5,087,499 | A | * | 2/1992 | Sullivan ..... 428/85 |
| 5,185,195 | A | | 2/1993 | Harpell et al. ..... 428/102 |
| 5,198,280 | A | | 3/1993 | Harpell et al. ..... 428/102 |
| 5,201,971 | A | | 4/1993 | Gifford ..... 152/536 |
| 5,225,241 | A | | 7/1993 | Dischler ..... 427/121 |
| H1225 | H | | 9/1993 | Foy et al. ..... 57/5 |
| 5,343,796 | A | | 9/1994 | Cordova et al. ..... 89/36.02 |
| 5,514,457 | A | * | 5/1996 | Fels et al. ..... 442/191 |
| 5,565,264 | A | * | 10/1996 | Howland ..... 442/246 |
| 5,578,358 | A | | 11/1996 | Foy et al. ..... 428/104 |
| 5,579,628 | A | | 12/1996 | Dunbar et al. ..... 57/246 |
| 5,622,771 | A | * | 4/1997 | Chiou et al. ..... 428/219 |
| 5,837,623 | A | * | 11/1998 | Howland ..... 442/189 |
| 5,976,996 | A | * | 11/1999 | Howland ..... 442/189 |
| 6,063,716 | A | | 5/2000 | Granqvist ..... 442/246 |
| 6,266,818 | B1 | | 7/2001 | Howland et al. ..... 2/2.5 |

FOREIGN PATENT DOCUMENTS

| | | |
|---|---|---|
| WO | WO 01/29299 A3 | 4/2001 |

* cited by examiner

*Primary Examiner*—Terrel Morris
*Assistant Examiner*—John J. Guarriello
(74) *Attorney, Agent, or Firm*—Maine & Asmus

(57) ABSTRACT

A protective fabric includes a plurality of warp yarns interwoven with a plurality of fill yarns. The denier of each of the warp and fill yarns is less than 500. The yarns are made from at least one of liquid crystal polyesters, para-aramids, and high density polyethylenes.

4 Claims, 5 Drawing Sheets

| CONSTRUCTION | 110x52 | 131x65 | 70x70 | 110x66 | 110x88 | 90x88 | 90x68 |
|---|---|---|---|---|---|---|---|
| WARP | 200 5z t29 | 200 5z t15 | 200 | 200 5z t29 | 200 5z t29 | 200 5z t29 | 200 5z t29 |
| FILL | 750 0z t29 | 400 4z t29 | 200 0z t15 | 400 4z t29 | 200 10z t2 | 200 10z t2 | 400 4z t29 |
| | | | | | | | |
| | | | | | | | |
| | | | | | | | |
| **PUNCTURE 3:1** | | | | | | | |
| ASTM 4 LAYER PUNCTURE #'s | 105.30 | 115.00 | 74.00 | 124.00 | 106.40 | 94.00 | 97.49 |
| #'s PUNCTURE/oz2 | 3.14 | 3.79 | 5.04 | 4.55 | 4.29 | 4.59 | 3.76 |
| $/#'s OF PUNCTURE | 1.15 | 1.02 | 1.13 | 0.81 | 1.10 | 1.01 | 1.19 |
| | | | | | | | |
| **PUNCTURE 12:1** | | | | | | | |
| 12:1 80 MIL #'s | 57.10 | 66.37 | 31.90 | 60.10 | 52.00 | 47.60 | 60.70 |
| #'s PUNCTURE/oz2 | 1.70 | 2.19 | 2.17 | 2.21 | 2.09 | 2.33 | 2.34 |
| $/#'s OF PUNCTURE | 2.12 | 1.77 | 2.61 | 1.68 | 2.26 | 2.00 | 1.90 |
| | | | | | | | |
| **KNIFE SINGLE EDGE** | | | | | | | |
| Ka_BAR CUT 4 LAYER #'s | 62.90 | 60.40 | 36.70 | 46.98 | 45.94 | 42.59 | 44.86 |
| #'s CUT/oz2 | 1.88 | 1.99 | 2.50 | 1.72 | 1.85 | 2.08 | 1.73 |
| $/#'s CUT | 1.93 | 1.94 | 2.27 | 2.15 | 2.56 | 2.24 | 2.58 |
| | | | | | | | |
| **KNIFE DOUBLE EDGE** | | | | | | | |
| EKCO DAGGER POINT #'s | 17.75 | 17.38 | 17.48 | 17.75 | 17.68 | 12.50 | 14.47 |
| #'s CUT/oz2 | 0.53 | 0.57 | 1.19 | 0.65 | 0.71 | 0.61 | 0.56 |
| $/#'s CUT | 6.83 | 6.75 | 4.77 | 5.68 | 6.65 | 7.62 | 7.99 |
| REF. NO. (Figs. 6,7) | (56) | (62) | (50) | (58) | (60) | (54) | (52) |

Fig. 5

GARMENT INCLUDING PROTECTIVE FABRIC

RELATED APPLICATION

This application is a continuation of application Ser. No. 09/453,773 now U.S. Pat. No. 6,548,430, filed Dec. 3, 1999, which is a continuation of application Ser. No. 09/289,208 pending, filed Apr. 9, 1999, which, in turn, is a divisional of 09/037,918 U.S. Pat. No. 5,976,996, filed Mar. 10, 1998, which, in turn, is a continuation of application Ser. No. 08/729,926 U.S. Pat. No. 5,837,623, filed Oct. 15, 1996, which, in turn, is a continuation of U.S. Pat. No. 5,565,264, filed Aug. 29, 1994.

BACKGROUND OF THE INVENTION

1. Field of the Invention

The invention relates to a protective fabric having a high resistance to penetration by instruments such as ice picks and the like and to vestments made from such fabric.

2. Description of Related Art

Protective clothing is used in a multiplicity of applications to protect the wearer against harm from a variety of objects such as knives, picks, bullets, and the like.

Protective clothing of the type worn by prison guards, among others, must be capable of withstanding assault by a variety of instruments. Typically, they are judged by their resistance to ballistic penetration (e.g., by 0.357 magnum and 9 mm ammunition); dagger cutting; penetration by single and double-edged knives; and puncture by both blunt (e.g., 3:1 ratio of tip diameter to shaft diameter) and sharp (e.g., 12:1 ratio of tip diameter to shaft diameter) instruments such as ice picks and the like. Of these measures of performance, one of the most difficult to achieve is resistance to puncture, particularly by sharp instruments.

Varied approaches have heretofore been utilized to provide the requisite protection. For example, U.S. Pat. No. 5,185,195 teaches the use of a number of layers of fabric secured together by closely spaced rows of stitching. Overlapping ceramic disks are also optionally incorporated into the vestment.

U.S. Pat. No. 4,737,401 teaches formation of a ballistic resistant fabric from high molecular weight fibers of polyolefin, polyvinyl alcohol, and polyacrylonitrile materials. The fibers may additionally be coated. U.S. Pat. No. 4,574,105 teaches the use of both polyester (p-phenylene terepthalamide) yarns and polyamide yarns. U.S. Pat. No. 5,225,241 teaches the enhancement to ballistic penetration by forming a vestment from coated fibers.

Because of the extreme demands made on the materials, they are frequently expensive to produce, both in fabric and in finished form. In addition, processes used to form the fabric and the finished article frequently result in a fabric and an article which is relatively stiff and not readily drapable. Accordingly, the user frequently finds such vestments unduly restrictive and uncomfortable, and often dispenses their use in situations where good safety practices would otherwise call for them.

Accordingly, it is an object of the invention to provide a fabric having improved penetration resistance.

Further, it is an object of the invention to provide a fabric having comparatively high resistance to penetration by both blunt and sharp instruments.

Still a further object of the invention is to provide a fabric having enhanced resistance to penetration by both blunt and sharp instruments.

Still a further object of the invention is to provide a fabric having enhanced resistance to penetration by both blunt and sharp instruments that is also characterized by a acceptable drapability.

Another object of the invention is to provide a fabric that has enhanced resistance to penetration by blunt and sharp instruments and that is characterized by a comparatively low cost per unit of protection provided.

Yet another object of the invention is to provide a vestment having enhanced resistance to penetration by blunt or sharp probes, as well as enhanced resistance to penetration by knives and ballistic penetration.

SUMMARY OF THE INVENTION

The present invention is directed to a protective fabric including a plurality of warp yarns interwoven with a plurality of fill yarns. A denier of each of the warp and fill yarns is less than 500. The yarns are made from at least one of liquid crystal polyesters, para-aramids, and high density polyethylenes.

BRIEF DESCRIPTION OF THE DRAWINGS

The foregoing and other objects and features of the invention will be more readily understood on reference to the following detailed description of the invention, when taken in connection with the accompanying drawings, in which

FIG. 5 is a chart showing the performance of a number of fabrics as measured by common tests for protective materials;

Figure 1A:
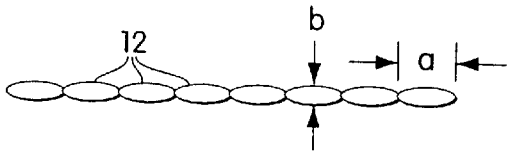
FIG. 1 is an illustrative sketch of a cross-section of fabric woven at a normal weaving density and showing an end-on view of warp yarns at the point of shed crossing between two fill yarns (FIG. 1A) and at the center of a fill yarn (FIG. 1B).

In accordance with the present invention, a protective fabric of high penetration resistance is formed from a plurality of layered, densely woven fabrics, each formed by tightly weaving multifilament yarns to obtain a warp yarn "density" or "cover" in excess of 100% at the center of the fill yarn. Further, the fill yarn density or cover is preferably also in excess of 75% as measured between two warp ends. The yarns themselves preferably comprise a high modulus (less than 5% elongation at the breaking point), high breaking strength (greater than 15 grams per denier) yarn. In an embodiment of the invention, the warp "crimp" (defined herein) preferably is greater than the fill "crimp". The warp and fill yarns are preferably twisted, consistent with the maximum breaking strength. Materials which have been found especially suitable for the present invention are the para-aramids (e.g., Kevlar); high density polyethylenes (e.g., Spectra); and liquid crystal polyesters (e.g., Vectran).

"Normal" density fabrics typically are 50×50 (i.e., 50 warp yarns to the inch by 50 fill yarns to the inch) to 70×70, for example, at 200 denier. Such fabrics have little resistance to penetration, even when used in multiple layers. In accordance with the present invention, however, a protective fabric having extremely high penetration resistance is formed by layering a plurality of densely woven fabric sheets of construction ranging from 90×88 to 130×86 at 200×200 denier, and from 100×100×68 to 130×65 at 200×400 denier. Fabrics at these levels of construction are known as "densely woven", "tightly woven" or "overconstructed", and are known but uncommon. They have heretofore been used in said cloth but not, to my knowledge, in protective clothing. For use in the present invention, the fabrics are preferably woven from a high-modulus, multi-filament material such as a standard type 29 Kevlar material. The resultant protective fabrics are characterized by high penetration resistance, good drapability, and relatively low cost per unit of resistance.

The number of layers of basic fabric used in the present invention, of course, depends on the threat against which the wearer is to be protected. For example, protection against penetration by a thin instrument such as an awl is extremely difficult. Yet, with the fabric and construction of the present invention, twenty five layers of a 100×67 weave of density 200×400 denier resisted penetration forces of up to 81 foot pounds as applied with an ice pick of 0.163 inch diameter at 5 meters/sec. When fifty four layers of this fabric were stacked together, the resultant composite resisted penetration up to an applied awl force of in excess of four hundred inch pounds.

The resistance to penetration and cutting by knives of vestments made from such material is also enhanced by incorporating this fabric into a vestment including additional plies of an outer layer of heavy yarn (e.g., 300–500 denier) with loose weave (e.g., from 15×15 to 18×18); a middle layer of conventional ballistic fabrics (e.g., from 27×27 to 31×31 and from 1000 to 840 denier material); and an innermost or bottom layer of the protective fabric of the present invention.

The dense construction of the fabric layers in the present invention greatly restricts in-plane motion, and thus requires increased out-of-plane extrusion for any significant penetration. The out-of-plane extrusion forces significantly accumulate over successive layers to the extent that further penetration requires the breakage of large numbers of high-modulus, high breaking-strength fibers before further penetration can be achieved. This not only limits penetration by thin, sharp instruments such as awls and picks, but also increases protection against sharp-edged instruments such as knives which must first penetrate before they can cut.

Figure 1B:
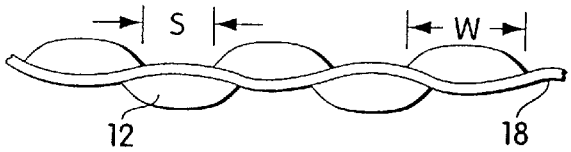

In FIG. 1, a plain woven fabric constructed in accordance with typical weaving practice (e.g., 70 warp threads per inch, 70 fill threads per inch, 200 denier warp, 200 denier fill (hereinafter denoted as a 70×70 (200×200) weave) has a plurality of warp yarns 12 extending lengthwise along the fabric (the lengthwise direction in this case being transverse to the plane of the paper of FIG. 1 so that the warp yarns are shown in cross-section) and traversed at intervals by fill yarns 14).

The yarns used to manufacture the fabric of FIG. 1 are multifilament bundles, generally round in shape. However, as may be seen from FIG. 1, when woven into a fabric, they assume a somewhat flattened, generally elliptical shape. This shape may be quantified to some degree by determining their "aspect ratio", that is, the ratio of their length "a" (as measured along their major axis or axis of greatest extent) to their width "b" (as measured along their minor axis or axis of least extent), both as measured at the point of shed crossing between two fill yarns as seen in FIG. 1A. For fabrics at normal weaving density, the aspect ratio is much larger than one, i.e., a/b>>1.

A second measure of the yarn shape may be obtained by examining the spacing of the warp yarns as measured at the point of crossing of a fill yarn, i.e., at the center of the fill yarn, and comparing this to the width of the warp yarns at the same location. The spacing between the warp yarns is shown as the distance "w". For fabrics at normal weaving density, the spacing ratio, s/w, approaches 1.

FIG. 1 is to be contrasted with FIG. 2, which is a tightly or densely woven fabric as used in accordance with the present invention and formed from warp yarns 16 and fill yarns 18. The fabric of FIG. 2 was plain woven from a 200 denier 5z t29 Kevlar multifilament warp ("5z" indicating 5 twists to the inch and "t29" the type number, designating normal Kevlar in this instance) and a 400 4z t29 Kevlar multifilament fill yarn at a density of 110 ends per inch warp, 67 picks per inch fill, i.e., a 110×67 (200×400) fabric. As opposed to the roughly oval or elliptical cross sections of the fabric of FIG. 1 at the shed crossings, the fabric of FIG. 2 has a squarer cross section, with as aspect ratio a/b much less than that of the fabric of FIG. 1 and indeed much closer to 1. Further, the spacing ratio, s/w, of the fabric of FIG. 2 is much less than that of the fabric of FIG. 1, and is much less than one, i.e., s/w<<1.

Figure 2A:
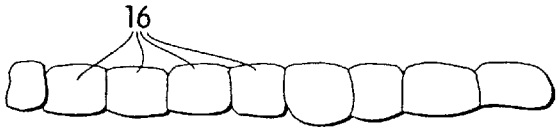
FIG. 2 is an illustrative sketch of a cross-section of densely-woven fabric and showing an end-on view of the warp yarns at the point of shed crossing between two fill yarns (FIG. 2A) and at the center of a fill yarn (FIG. 2B)
FIG. 2C is an enlarged illustrative sketch of several of the yarns of FIG. 2A showing the flattened "keystone" structure of the yarns.
Figure 2B:
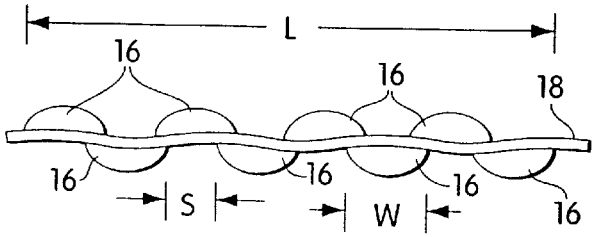
Figure 2C:
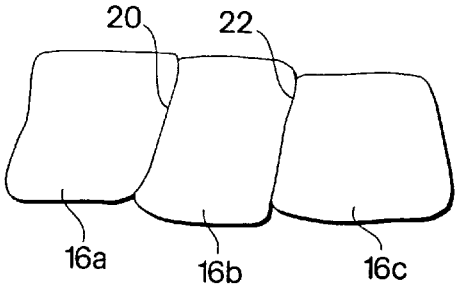

A more detailed examination of the warp structure of the fabric of FIG. 2 at the shed cross shows that the warp yarns have a "keystone" structure, that is, the yarn cross sections have been distorted by the weaving into roughly square shapes such that adjacent yarns have opposed and complementary slopes at their mating surfaces. This shown more clearly in FIG. 2C which is an enlarged view of three adjacent yarns from FIG. 2A at the shed crossing. The yarns 16*a*, 16*b*, 16*c* mate together pairwise at common interfaces 20 and 22, respectively. At these interfaces, when traversing the yarn surfaces in a clockwise direction, the right face of the leftmost yarn of a pair, e.g., yarn 16*a*, slopes down and to the left, while the left face of the rightmost yarn of a pair, e.g., yarn 16*b*, slopes up and to the right. The result is an interlocking structure that resists yarn movement out of the plane of the fabric, and thus provides significant penetration resistance.

Figure 3:
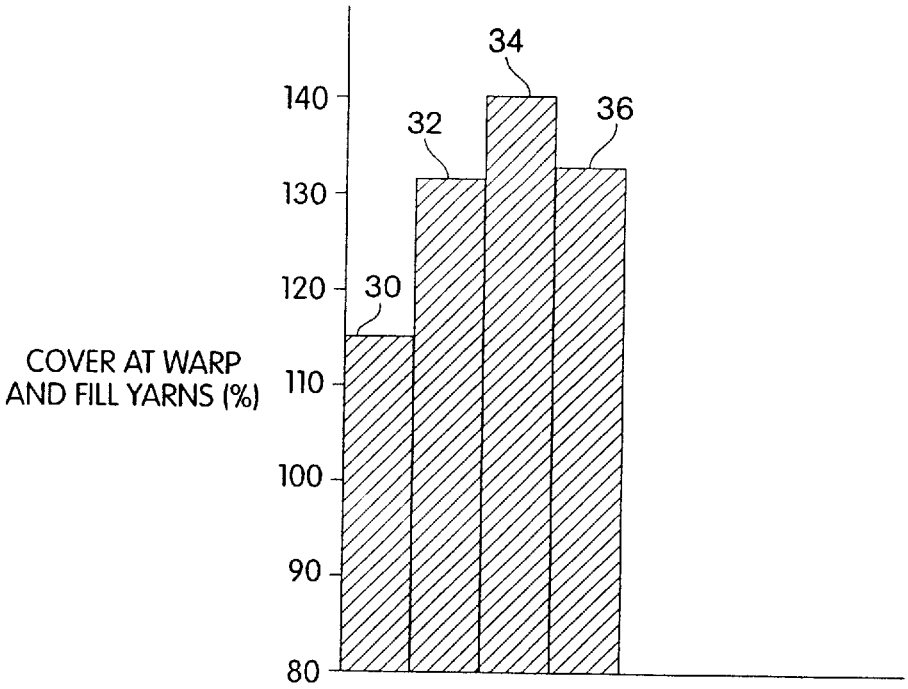
FIG. 3 is a graph showing the "cover" of various density weaves.

Another indicator of the geometric structure of the fabric of the present invention is the amount of overlap or "cover" between adjacent warp yarns as measured at the fill crossing. Referring to FIG. 2B, the cover may be determined as the sums of each of the widths w of the yarns in a given cross section, divided by the length, "1", of the cross section. Referring now to FIG. 3, the cover of a typical normal fabric (70×70, 200×200) as well as that of several densely woven yarns in accordance with the preset invention is shown. As seen in FIG. 3, the cover 30 of the normal fabric is of the order of approximately 115%, with 100% indicating essentially no overlap, on average. In contrast, the cover of densely woven fabrics in accordance with the present invention is significantly higher. Thus, the cover 32 of a 90×88 (200×200) fabric is of the order of 130%. The cover 36 of a 110×67 (200×400) fabric is seen to be just slightly in excess of the 90×88 fabric, while the cover 34 of a 131–65 (200×400) fabric is even higher, approximately 140%.

Figure 4:
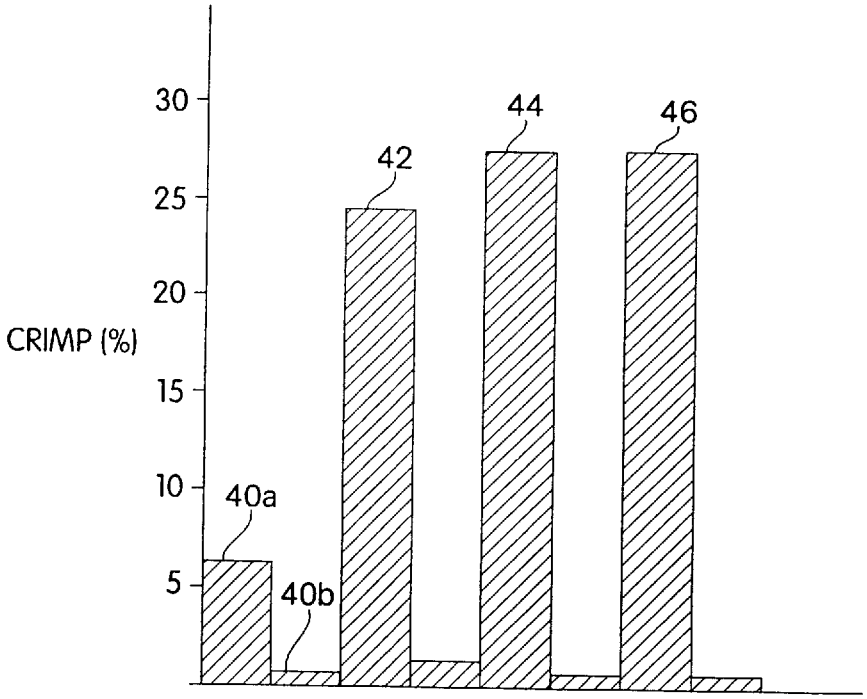
FIG. 4 is a graph showing the "crimp" of various density weaves.

Still another measure of the structure measure of the structure of the fabric of the present invention is the ratio of its "crimp" in the warp direction verses its crimp in the fill direction. The crimp in a given direction (warp or fill) is defined as the length of a given section of yarn along that direction when woven divided by the length of the same yarn when freed from its woven state in the section. FIG. 4 shows the amount of crimp for different fabrics, namely, a 70×70 (200×200) (indicated as element 40), a 90×88 (200×200) (element 42), a 110×67 (200×400) element 44), and a 131×65 (200×400) (element 46) fabric. The crimp along both the warp (e.g., 40*a*) and fill (e.g., 40*b*) directions for each of these fabrics is given. It is readily seen that the crimp in the normal fabric (element 40) is significantly less than that of the densely woven fabrics used in the present invention. (42, 44, 46).

As discussed above, the high cover or density of yarn packing in the warp and fill directions relates directly to the closed interstices which are critical to penetration resistance. Another important factor adding to penetration resistance of the tightly packed structure is the asymmetry of the crimp of the warp and fill yarns. In order for the fill yarns to be packed closely together, the warp yarns must follow an increasingly crimped serpentine path.

As defined above, the crimp is the ratio of a gauge length of yarn in the woven substrate to the yarn length after being removed from the woven substrate and extending it straight. In one embodiment of the present invention, the crimp of the warp yarn is greater than the crimp of the fill yarn, resulting in a tightly packed woven structure that exhibits high penetration resistance. In an example of the present invention, using a 200 denier warp yarns at 110 ends and 400 denier fill yarns at 66 pics, the fill yarn crimp falls within the range of 1%–2% and the warp yarn crimp falls within the range of 25%–27%. When viewed, the highly crimped warp yarn resembles a serpentine shape and forms a tube-like structure around the relatively straight fill yarn. A very dense weave structure requires a high-warp crimp. The high warp crimp is necessary for forming a tight structure with minimally sized openings in the interstices. It should be understood, however, that highly crimped yarns can be made without enough yarns per inch in the warp direction to form a tight enough weave for sufficient puncture-resistance performance to suit a particular application. Thus, both the packing density and the high warp crimp are important for puncture-resistance.

FIG. 5 summarizes the performance of a number of fabrics with respect to several generally accepted performance measures for protective fabrics performance measures for protective fabrics. Four test conditions are shown, namely, penetration with a 3:1 instrument; penetration with a 12:1 instrument; cutting with a single edge knife; and cutting with a double edge knife. The penetration resistance in the 3:1 test is measured by the standard ASTM four layer penetration test; that for the 12:1 test is for penetration by an 80 mil probe. The single edge knife test is the Ekco dagger point test. In each case the penetration or cutting resistance is measured in pounds of force. The resistance per square ounce of fabric is also tabulated, as well as the effective cost of the fabric per pound of resistance.

Figure 6:
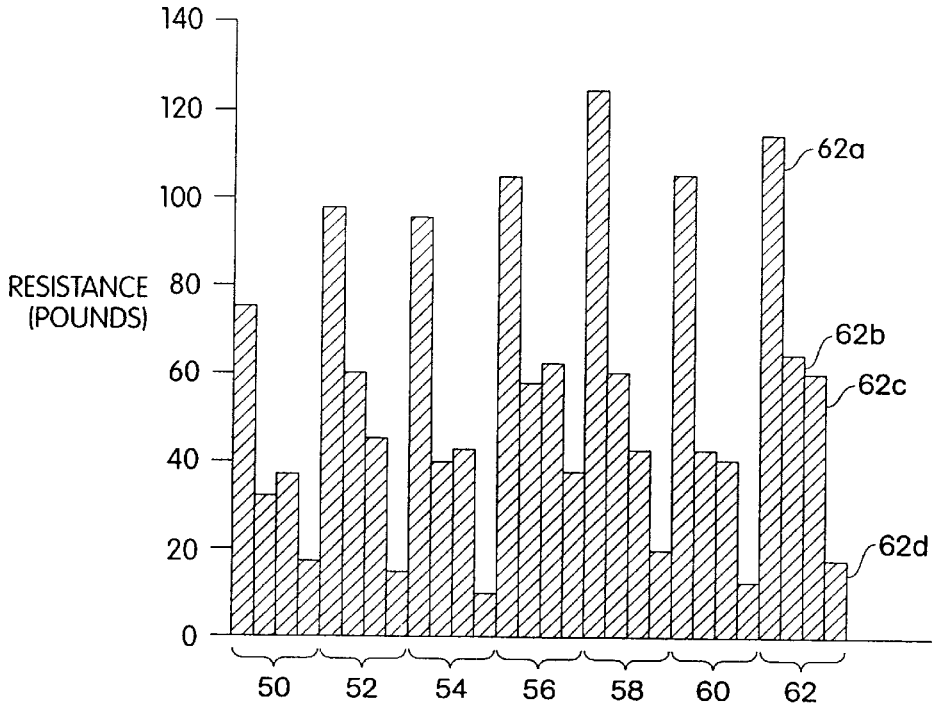
FIG. 6 is a graph showing the resistance to penetration of the fabrics of FIG. 5.
Figure 7:
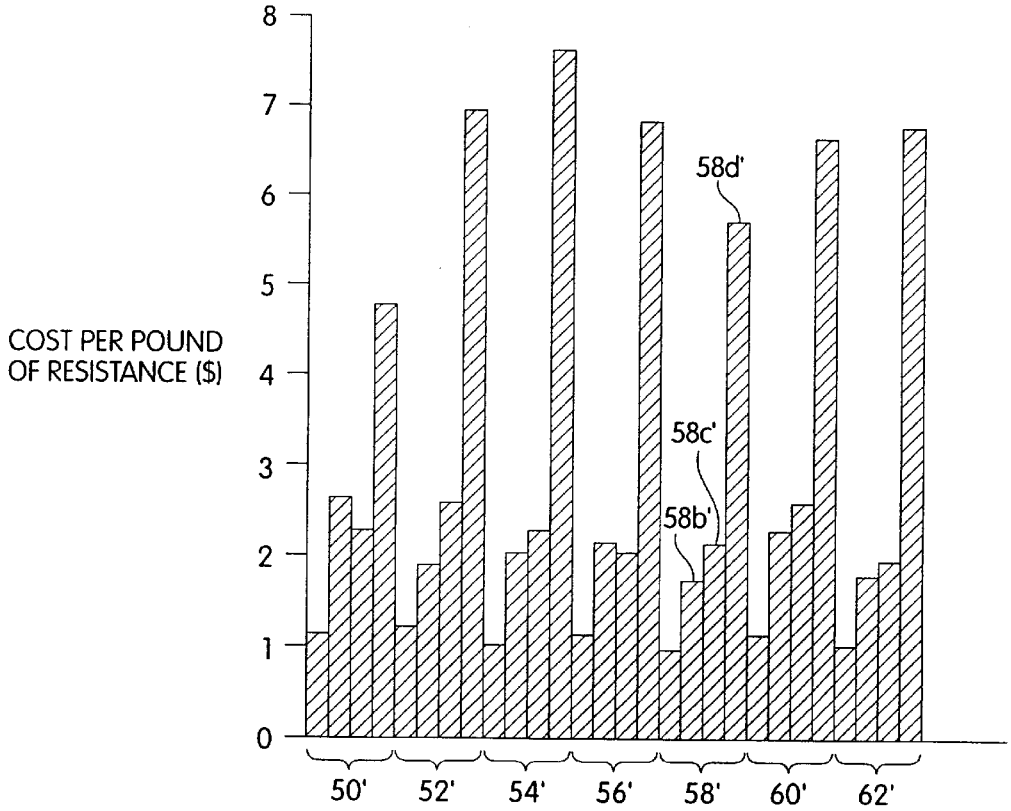
FIG. 7 is a graph showing the cost/benefit performance of the fabrics of FIG. 5.

The latter figure, as well as the resistance in pounds of the various materials listed in FIG. 5, are shown graphically in FIGS. 6 and 7. In each figure, four data points are shown for each fabric material listed in FIG. 5. For example, in FIG. 6, the material identified as a 131×65 (200 5z t29, 200 10z t2) fabric in FIG. 5 has a 3:1 penetration resistance as shown at 62*a*; a 12:1 penetration resistance as shown at 62*b*; a single edge knife resistance as shown at 62*c*; and a double edge knife resistance as shown at 62*d*.

From FIG. 6, it will clearly be seen that the 110×67 (200×400) fabric (58) is clearly superior in the 3:1 penetration test, and is better than all but one of the other fabrics in the 12:1 penetration test. Additionally, it has a fairly high rating in the singles edge knife test, and is as strong as any other fabric in the double edge knife test. Thus it offers superior penetration resistance, while retaining excellent knife edge resistance.

An important consideration in a protective fabric is its cost per unit of protection. This is shown in FIG. 7 for the various fabrics of FIG. 5 and for each of the four threats. For example, for the 110×67 (200×400) material discussed above, the cost per pound of resistance of this material for the four types of threats, namely, 3:1, 12:1, single edge knife and double edge knife is shown at 58*a*', 58*b*', 58*c*', and 58*d*', respectively. It will be seen from this that the 110×67 fabric has superior cost performance in the 3:1 and 12:1 penetration test, while retaining excellent relative performance in the single and double edge knife tests.

The number of layers of the base fabric, and the specific type of fabric of each layer, will vary with the types of threat against which protection is to be maximized. For example, for protection primarily against harm by penetration, in excess of thirty layers of 110×67 (200×400) fabric will generally be effective. For protection against multiple threats, such as both penetration and cutting (knife threats), a combination of layers of protective fabric of varied but dense weaving may be used, including a coated base fabric as described in more detailed below.

As discussed above, the preceding fabric structures offer excellent resistance to puncture and additionally provides significant resistance to penetration by sharp knives. The resistances to the latter can be enhanced even more in accordance with a further embodiment of the present invention illustrated in FIG. 8. In that figure, a densely woven fabric is shown coated in interrupted or patterned fashion with a high modulus lamination epoxy spread over the fabric at a rate of 2–5 ounces per square yard. The pattern illustrated in FIG. 8 for example comprises a plurality of rectangular coated areas or "islands" 70 separated by uncoated "streets" 72. The "islands" provide high in-plane resistance to the flat faces of a knife attempting to penetrate the material, and thus enhance resistance to penetration, while the "streets" provide a bending capability to the otherwise rigid material.

The diameters and diameter ratios of the warp yarn to the fill yarn may be selected to optimize performance and manufacturing ease of the highly warp crimped weave of the present invention. As explained below, a balance must be struck in selecting a yarn diameter between yarn wear incurred during weaving and increased weave density. The reed drive of a weaving machine provides the mechanical force necessary to weave the yarns into place in the weave substrate. As yarn diameter increases, the force required to bend the warp yarns around the filling yarns increases substantially. Thus, yarn wear also increases as the diameter of the yarn increases with the highly warp crimped structure of the present invention. In addition, greater density warp yarns are more difficult to weave in a tightly woven structure than less dense yarns because the bending force necessary to crimp the larger yarns negatively effect the operation of the reed drive. Further, larger density yarns yield a stiffer fabric as the resulting weave is thicker, rendering such yarns less than optimal for applications in which a flexible fabric is desired. Increasing the diameter of the yarns, however, increases the density of the woven structure and provides improved penetration resistance, therefore providing a general desire to increase yarn density. For certain applications, it was determined that 200 denier yarns exhibit an ideal balance between yarn wear during weaving and increased weave density.

It was discovered that using a fill yarn having twice the denier of that of the warp yarn offers an optimal ratio for packing yarns into dense weaves. If a smaller diameter fill yarn is used, then the crimp radii in the warp yarns become smaller and consequently harder to generate. Larger diameter fill yarns overcome the small crimp warp yarn radii drawback associated with the use of smaller fill yarns. As larger diameter fill yarns are used, however, such that the ratio of fill yarn diameter to warp yarn diameter increases above 2:1, the filling stiffness increases and the resulting fabric is more difficult to bend along the fill direction, rendering it less than optimal for certain applications in which a flexible fabric is desired.

In addition to the drawback associated with fill direction stiffness, it was discovered that a 2:1 ratio of fill yarn diameter to warp yarn diameter yields approximately balanced fabrics from a denier-per-inch perspective with the high warp crimp woven substrate of the present invention. The breaking strength of the resulting fabric along either of the thread line directions depends on the number of yarns and their sizes. Yarn count-per-inch times the yarn denier reveals the total fiber content. A fabric having approximately equal denier-per-inch along each of the directions yields high puncture resistance efficiency on a per-weight basis.

Continuous filament yarns are one type of yarns that can be used with the high density woven substrate of the present invention. The yarn manufacturing processes that produces the continuous filament yarns having high strength and high modulus can yield, for example, a bundle of filaments having 1.5 to 5 denier per filament, or 55 to 1500 denier per bundle. Each of the filaments in such a bundle is continuous.

In addition to continuous filament yarn type, the short fiber or "staple" yarn type can be used with the substrate of the present invention. In the cotton and wool yarn manufacturing process, short fibers, or staples, are twisted together into longer yarns. Because of the throughput available to the yarn manufacturer, spinning a large yarn and slicing that yarn into shorter fiber, "staple" yarns, can produce fiber at lower costs. The staple fiber then can be twisted into yarns having a range of different deniers and lengths. The cost of using staple yarns to produce 100 to 400 denier yarns is much less than the cost of using continuous filament yarn of the same denier. While staple yarns can be used with the highly densely woven substrate of the present invention and are desirable in terms of their reduced cost, in some circumstances the resulting substrate offers lower performance in terms of stab and puncture resistance.

1.5 inch staple yarns, for example, can be used with the tightly woven substrate of the present invention for tensile loading. Typically, staple yarns are used only where the fabric will undergo slight tensile or tear loading. With a tightly woven substrate, and the use of high modulus coatings, the short fibers can trade load and shear effectively and work well against tensile and tear.

A special process used for making staple yarns is known as "stretch breaking". With this process, a larger yarn is drawn down and individual filaments are broken to allow for the denier to be reduced. Such stretch broken yarns are available in deniers below 200 and in staple or filament lengths of up to 40 inches. One cotton system for spinning yarns of 1.5 inch staple, for example, is limited to yarns in para-aramids to approximately 100 denier. In order to produce a weavable warp yarn, such 100 denier yarn must be plied to produce yarn with adequate abrasion resistance for weaving tight fabrics. Stretch-broken yarns allow for the production of a very long staple yarn of 50–100 denier which can be used unplied as warp yarn. Short staple yarns allow for the production of the 200×400 denier designs with low material cost. Stretch-broken yarns also enable for the production of a thinner, more flexible fabric for reasonable cost.

In an embodiment of the invention, the base fabric comprised a 110×67 densely woven fabric coated with a Gougeon Bros. type 126 epoxy resin applied at a rate of from two to five ounces per square yard. The resin was set by means of a Gougeon Bros. type 226 hardner, with curing first at room temperature and then at 140° F. This material has a tensile modulus on the order of $5\times10^5$.

Figure 9:
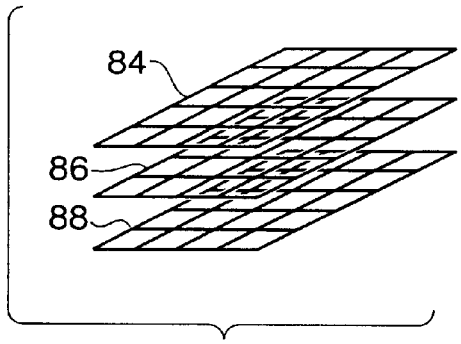
FIG. 9 is a sketch of a plurality of the fabric sheets of FIG. 8 assembled into a stack for forming a vestment therefrom.

The patterned structure is preferably formed on the base fabric in a manner similar to photographic methods, i.e., a material resistant to bonding to the epoxy (e.g., paraffin or the like) is first laid down on the fabric in the pattern of the streets. This may be accomplished by silk screening, gravure printing, or other known techniques. The epoxy is then applied in a thin, even layer over the material and hardened. The resist material is then removed, exposing the underlying, uncoated streets between the coated lands. In the test example described herein, the "islands" were on the order of one inch square, while the streets were on the order of one-sixteenth wide. In forming a protective garment, the base structure is stacked in a plurality of layers, e.g., layers 84, 86, and 88 as shown in FIG. 9, and cut to site. The layers may be jointed by any of various well-known means, such as stitching them together, etc.

The resultant structure was tested by stacking 14 sheets of this material and subjecting the stack to a standard H B White drop test. This test uses a 16.2 pound weight to drive a Russell boning knife into the layered stack. The height from which the weight must be dropped in order to penetrate a stated number of layers is a measure of the penetration resistance of the stack. In the present case, it was found that the knife failed to penetrate the fourteenth layer when the drop was made from up to nearly 2.5 feet above the stack, corresponding to a penetration energy of 40 foot pounds. Indeed, the knife buckled in consequence of the resistance provided by the stack.

Figure 8:
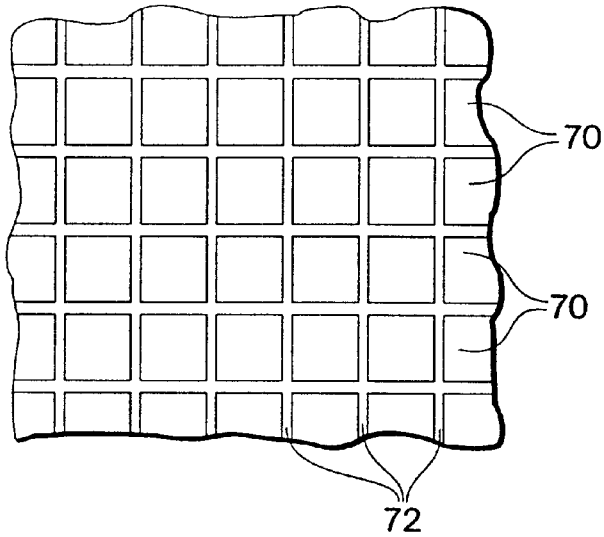
FIG. 8 is a sketch of an alternative form of fabric used in constructing protective fabric in accordance with the present invention having particularly enhanced resistance to cutting penetration of the type encountered with thin, sharp knives.

The embodiment of FIG. 8 does not provide the high drapability of the fabric structures previously described, but it nonetheless does provide adequate drapability accompanied by an extremely high degree of protection. The "streets" of the fabric not only serve as hinge points for bending, but also provide pathways for "breathing", thus contributing to a more comfortable wear for the user. The "islands" may vary in size from fractions of an inch along the maximum dimensions, to inches; the streets typically are narrow, i.e., on the order of fractions of an inch. Further, the islands may take any shape, i.e., square, rectangular, diamond, circular, etc. The smaller the islands, the more hinge points for bending are provided; however, this also reduces the ratio of the coated area (islands) to uncoated area (streets) and thus requires a greater number of layers to obtain a desired level of protection. Of course, care must also be taken to avoid alignment of the streets in successive layers, since such alignment also reduces the effective protection obtained from the material.

The tightly woven substrate of the present invention offers penetration resistance both to circular and cutting type penetrators. Based on tests, the substrate of the invention offers the following advantages. 1) The substrate provides resistance to circular penetrators such as ice pics, awls and homemade prison weapons. 2) The substrate provides resistance to cutting edge penetrators including UK test knives, German Othello test daggers and U.S. Russell boning knives. 3) The substrate provides resistance to small diameter penetrators likes thorns and sharp sticks. 4) The substrate provides resistance to puncture by small cutting penetrators like hypodermic needles. 5) The substrate provides cut and slash resistance approximately 19 times greater than that offered by ballistic fabrics. 6) The substrate provides reduction of depth of trauma resulting from ballistic type impacts. Used in combination with and placed behind typical ballistic materials, the substrate of the present invention reduces measured backside trauma depth by a factor of 2 to 3 times. This allows for an attractive combination of ballistic performance where NIJ ballastic performance of a level 2a or 3 can be achieved with layer counts similar to current ballistic vest-only systems. The ballistic performance was maintained by substituting □ to ½ of the ballistic layers with the substrate of the present invention. Dramatic improvements in stab and puncture resistance were achieved. The depth of backside trauma is much improved over the all-ballastic product. 7) The substrate provides reduction of blunt trauma resulting from blows from striking club-like weapons and thrown objects such as sharp stones. As above, the substrate of the present invention provided significant reduction in the depth of the affected zone. The high-bias stiffness of the tightly woven substrate of the present invention prevents the material from forming deep concave indents. The substrate of the invention strongly resists being bent into compound curves having small radii. In order for a striking blow or a rock to deeply indent the substrate, the fabric must conform to this concave shape. The substrate of the invention, with its very high off-thread line and bias stiffness, lacks the drape and elongation necessary for the deep indenting. The substrate of the invention spreads out the point of contact and distributes the impact forces over a large area of tissue. Based on the use of Roma plastilina as a tissue stimulant, 1–4 layers of the substrate of the invention can reduce the depth of trauma by a factor of 5–10 times. 8) The substrate of the invention provides abrasion resistance for sliding wear situations in industrial protective apparel. Gloves, gauntlets, aprons and chaps all require a combination of cut and abrasion resistance. The substrate of the present invention offers excellent cut and abrasion resistance to suit the industrial protective apparel application.

Having thus described at least one illustrative embodiment of the invention, various alterations, modifications and improvements will readily occur to those skilled in the art. Such alterations, modifications and improvements are intended to be within the spirit and scope of the invention. While the present invention was described with reference to particular types of threads, thread sizes, lengths, diameters and ratios, such features were listed merely for example and can be replaced with other threads to suit a particular application. Accordingly, the foregoing description is by way of example only and is not intended as limiting. The invention is limited only as defined in the following claims and the equivalents thereto.

What is claimed is:

1. A garment for protection against puncture and penetration comprising:

a protective fabric substrate including:

a plurality of warp yarns densely interwoven with a plurality of fill yarns wherein the warp yarns and fill yarns comprise stretch broken or staple fibers and the warp crimp is at least four times greater than the fill crimp; and wherein the yarns arc made from at least one of liquid crystal polyesters, paraamids, and high density polyethylenes.

2. The garment as claimed in claim 1 wherein the protective fabric forms only a portion of the garment.

3. The garment as claimed in claim 1 wherein the protective fabric substrate has a cover between adjacent yarns at a fill crossing that is at least 100%.

4. A garment for protection against puncture and penetration comprising:

a protective fabric substrate forming at least a portion of the garment and having a plurality of warp yarns densely interwoven with a plurality of fill yarns wherein the warp yarns and fill yarns comprise stretch broken or staple fibers made from at least one of liquid crystal polyesters, paraamids, and high density polyethylenes; the warp crimp is at least four times greater than the fill crimp; and wherein the protective fabric substrate has a cover between adjacent yarns at a fill crossing that is at least 100%.

* * * * *